United States Patent [19]

Katz

[11] Patent Number: 4,490,061

[45] Date of Patent: Dec. 25, 1984

[54] WRITING INSTRUMENT FOR AUTOMATIC ADVANCEMENT AND FEED OF LEADS

[75] Inventor: Otto Katz, Schwabach, Fed. Rep. of Germany

[73] Assignee: A.W. Faber-Castell, Nuremberg, Fed. Rep. of Germany

[21] Appl. No.: 370,126

[22] Filed: Apr. 20, 1982

[30] Foreign Application Priority Data

Jun. 27, 1981 [DE] Fed. Rep. of Germany ..... 3125441

[51] Int. Cl.[3] ..... B43K 21/02

[52] U.S. Cl. ..... 401/53; 401/65; 401/67; 401/94

[58] Field of Search ..... 401/53, 65, 67, 93, 401/94, 81

[56] References Cited

U.S. PATENT DOCUMENTS

| | | | |
|---|---|---|---|
| 1,447,677 | 3/1923 | Lindberg | 401/67 |
| 1,729,786 | 10/1929 | Lindberg | 401/53 |
| 1,729,791 | 10/1929 | Morris | 401/53 |
| 4,180,339 | 12/1979 | Katz | 401/65 X |

FOREIGN PATENT DOCUMENTS

| | | | |
|---|---|---|---|
| 436912 | 11/1926 | Fed. Rep. of Germany | 401/65 |
| 807367 | 7/1952 | Fed. Rep. of Germany | 401/65 |
| 2837586 | 3/1980 | Fed. Rep. of Germany | 401/65 |
| 946825 | 6/1949 | France | 401/67 |

*Primary Examiner*—Steven A. Bratlie

*Attorney, Agent, or Firm*—Michael J. Striker

[57] ABSTRACT

A writing instrument with automatic advancement and feed of successive leads has a housing having a tip part, a lead protecting pipe having an axis and movable in an axial direction, a lead container spaced from the lead protecting pipe in the axial direction, a gripping sleeve extending between the lead container and the lead protecting pipe, a lead clamping member having a plurality of clamping arms and movable between open and closed positions in the axial direction, wherein the clamping arms of said lead clamping member are arranged to abut against the gripping sleeve under a spring action and having a clamping opening with a receiving portion, and the lead clamping member has a shaft connected with said clamping arms with a region adjacent to the latter, and a tilting member provided in the region of the shaft of the clamping member and arranged so that during movement of the lead protecting pipe to the tip part of the housing the tilting member displaces on the shaft of the clamping member, and during movement of the lead protecting pipe in an opposite direction out of the tip part of the housing the tilting member becomes firmly connected with the shaft of the clamping member.

18 Claims, 20 Drawing Figures

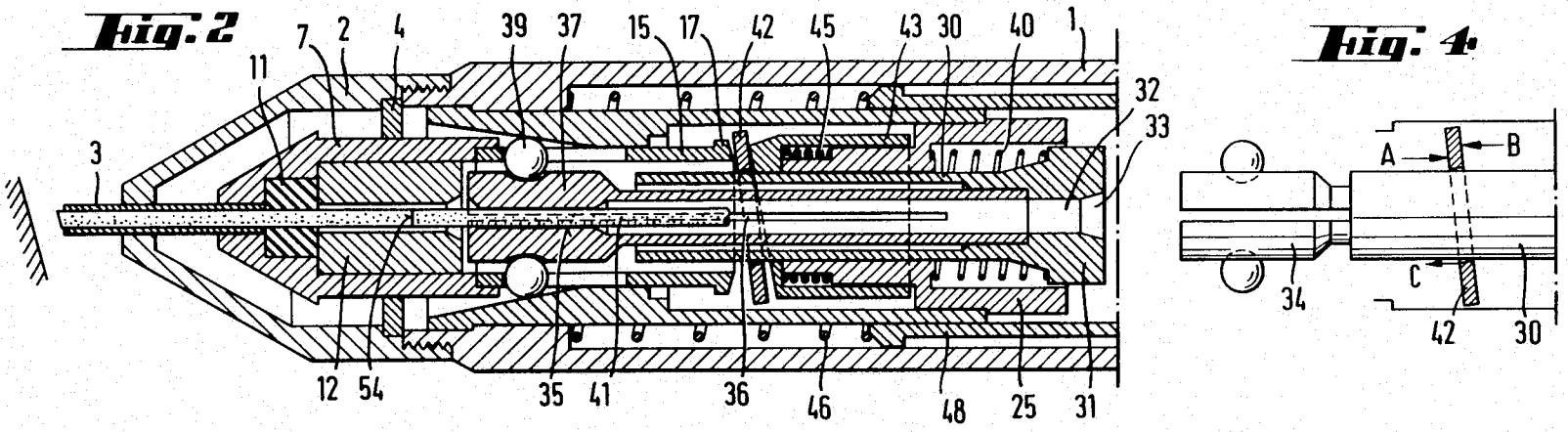
Fig. 2
Fig. 4
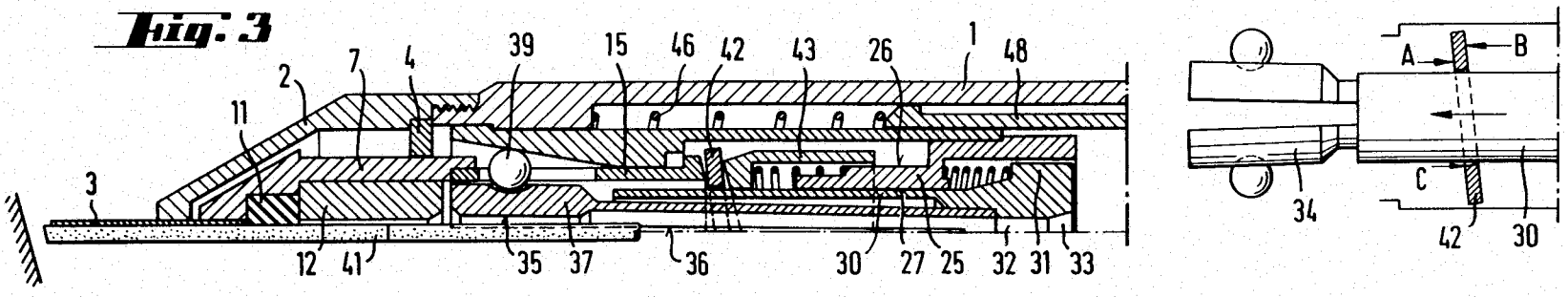
Fig. 3
Fig. 5

C-D

A-B

WRITING INSTRUMENT FOR AUTOMATIC ADVANCEMENT AND FEED OF LEADS

BACKGROUND OF THE INVENTION

The present invention relates to a writing instrument with automatic advancement of a lead and feeding of successive leads.

Writing instruments of the above-mentioned general type are known in the art. A known writing instrument has a spring-biassed writing pipe actuated by the lead advancement and connected with a lead receiving device, and a clamping member with several clamping arms which is longitudinally movable for closing and opening and abuts under the action of a spring against a gripping sleeve, wherein its clamping opening communicates with an inlet funnel facing toward the lead container. In lead writing instruments with automatic advancement of solid leads actuated by the writing pressure and released by lifting of the instrument from the substrate, a free passage from the lead container to a brake element connected with the writing pipe must be guaranteed so as to provide that without additional actuation of an adjustment member, leads can be automatically transported one after the other from the lead container through the clamping opening of the clamping member to the front end of the lead protecting pipe. During writing and wearing of the lead, it must be continuously supported against the writing pressure and, immediately after lifting of the lead protecting pipe from the object to write on, transportation of the lead synchroneously with the lead protecting pipe must be carried out. The length of the lead to be transported must have no influence upon the intended functions.

One of such writing instruments is disclosed, for example, in the German Offenlegungsschrift No. 2,837,586. In the instrument described in this reference both the lead can be automatically transported forwardly, and a free passage from the lead magazine to the braking member on the lead protecting pipe is provided. For this purpose, after each lifting of the tip of the instrument from the object, the lead moves forwardly through the carrying element and the clamping member is simultaneously opened so wide that a subsequent lead can move from the lead container through the clamping opening of the clamping member. The axial movement relative to the gripping sleeve required for opening of the clamping member is actuated by a coupling which engages in the counter member via a control edge. In order to provide for a coupling, a certain minimal stroke of the lift protecting pipe and the connected coupling member must be first carried out to reach the control edge which releases the coupling process. During such a movement process, it can happen that in the event of frequent short lines the lead automatically moves forwardly and thereby a lead transportation takes place. The clamping member is not opened but frictionally abuts against the lead so that a lead cannot fall from the lead container through the clamping opening of the clamping member and can be engaged by the elastic carrying element.

SUMMARY OF THE INVENTON

Accordingly, it is an object of the present invention to provide a writing instrument which avoids the disadvantages of the prior art.

More particularly, it is an object of the present invention to provide a writing instrument with automatic advancement of leads in which during minimum paths or insignificant wear of the lead both an automatic advancement of the lead and an automatic feed of successive leads are guaranteed.

In keeping with these objects and with others which will become apparent hereinafter, one feature of the present invention resides, briefly stated, in a writing instrument which has a tilting member provided in a region of the shaft of a lead clamping member, the region being connected with clamping arms, which is arranged so that during movement of a lead protecting pipe in a tip part of the instrument the tilting member displaces on the shaft of the clamping member, and during movement of the lead protecting pipe in an opposite direction out of the tip part the tilting member becomes firmly connected with the shaft of the clamping member.

When the writing instrument is designed in accordance with the present invention, automatic advancement of the lead is provided in the event of smallest paths or insignificant wear of the lead, as well as an automatic advancement and an automatic subsequent feed of the successive leads. The coupling for opening the clamping member must be in the position such that even in the event of smallest paths, the lead protecting pipe is displaced back for advancement of the lead, the clamping member is opened so wide that a lead can freely fall through the same. The construction of the lead instrument, which must be provided with such a coupling, is so designed that a simple mounting can be performed, which is particularly attained by the fact that it is not necessary to assemble the individual parts so as to place them in a certain position. The individual parts must have a simple construction as possible so that to provide with the required sensitivity of the coupling, indispensible small tolerances. The construction must also be such as to provide for efficient manufacture of the individual parts.

Furthermore, the inventive writing instrument does not require from a user to perform functions which need clarification. In the initial position of the writing instrument, leads must be filled into the same. All further functions such as advancement of the lead and feed of the replacement leads are performed automatically regardless of the position of the instrument tip.

In accordance with another advantageous feature of the present invention, an especially simple construction of the instrument without any control element can be obtained when a conical sleeve which receives the clamping member is fixedly mounted in a housing of the instrument.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a view showing a longitudinal section of the writing instrument of FIG. 1 with a partially withdrawn writing pipe;

FIG. 3 is a view showing a longitudinal section of the writing instrument of FIG. 1 during a forward movement of the writing pipe;

FIG. 4 is a schematic view showing forces which act on a coupling during wearing of a lead;

FIG. 5 is a view schematically showing forces acting upon the coupling during the advancement through the writing pipe;

DESCRIPTION OF THE PREFERRED EMBODIMENT

Figure 1:
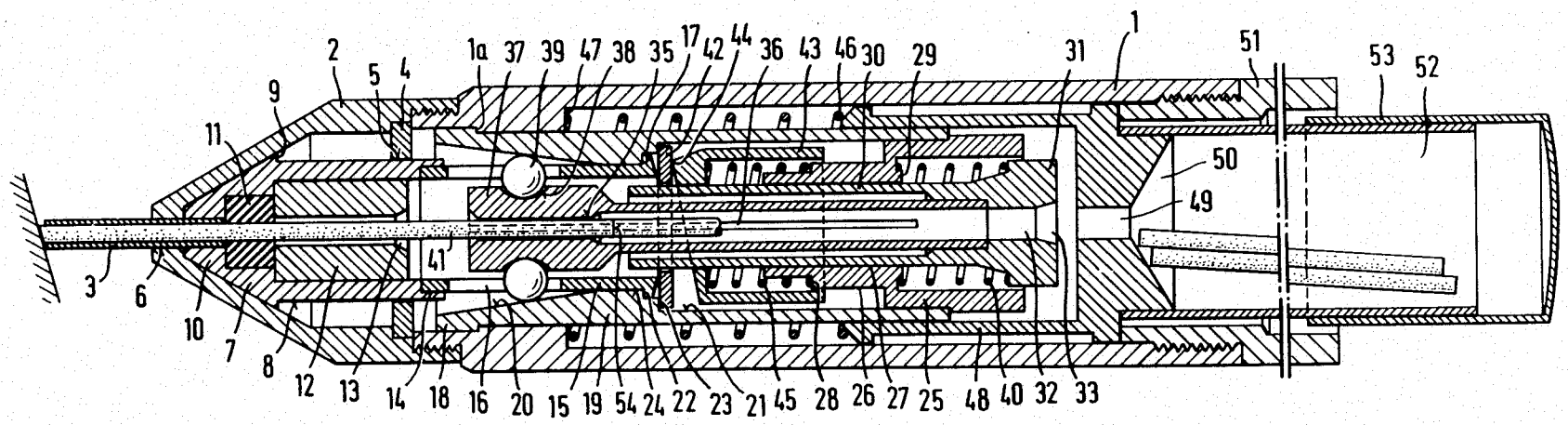
FIG. 1 is a view showing a longitudinal section of a writing instrument in accordance with the present invention, in an initial position ready to write.

A lead writing instrument in accordance with the invention is shown in FIG. 1 in an initial position ready-to-write. The writing instrument has a housing identified by reference numeral 1, and a tip 2 which is connected with the housing 1 by a thread or similar connecting means in releasable or non-releasable manner. The tip 2 is hollow and contains a fixedly positioned ring 4 with an opening 5. A displaceable member 7 is arranged axially movable in the opening 5 of the ring 4 and in an outward opening of the tip 2. The displaceable member 7 has a cylindrical supporting face 8 limited by an abutment 9 and connected with a cone 10 which corresponds to the inner faces of the tip 2. In the displaceable member 7 there are mounted a lead protecting pipe 3 and an elastic lead brake 11 located immediately therebehind. The lead brake 11 is retained by an insert 12 which has an inlet funnel 13 at its one side. The displaceable member 7 is provided at its end facing toward the interior of the instrument with a recess 14 in which a pressure sleeve 15 is mounted. The latter has a plurality of cut-outs 16 and a chamfered annular bead 17 at its end facing away from the displaceable member 7.

The housing 1 has at its front end a projecting portion which is limited at its one side by an abutment 1*a* and at its other side by a shoulder 47. A conical sleeve 19 provided with an abutment bead 18 is inserted into the above-mentioned projecting portion of the housing and has an inner cone 20. The conical sleeve is movable in a longitudinal or axial direction over an advancement paths "v". An opening 21 communicates with the inner cone 20 and is enlarged via a step formed as an annular face 22 and a further abutment face 23, into an opening 24. An abutment bush 25 is fixedly inserted in the conical sleeve 19 at its one end. A cylindrical part is formed on the abutment bush 25 and serves both as an outer support 26 and as an inner support 27. Moreover, a supporting face 28 and an annular bead 29 are provided for supporting pressure springs whose action will be explained hereinbelow.

In the inner support 27 of the abutment bush 25, a gripping sleeve 30 is arranged movable in the longitudinal direction. The gripping sleeve 30 has a head piece 31 forming a lead guiding opening 32 and an inlet funnel 33. A clamping member 34 with a clamping opening 35 is pressed into the gripping sleeve 30 adjacent to the lead guiding opening 32. The clamping member 34 has at least two springy clamping arms 37 separated from one another by a slot 36. Spherical pockets 38 are formed in the clamping arm 37 for receiving balls 39. The clamping member 34 is retained in a predetermined position by an equalizing spring 40 which is supported between the head piece 31 and the annular bead 29 of the abutment bush 25. More particularly, the clamping member 34 is retained by the equalizing spring 40 in the position which is obtained by abutment of the balls 39 against the inner cone 20 and in the ball pockets 38, so that the springy clamping arms 37 abut against one another or embrace a lead 41.

A clamping disk 42 is further supported on the gripping sleeve 30 and has an inner diameter which is insignificantly greater than the outer diameter of the gripping sleeve 30. A shaft 30' of the clamping member 34 extends in the gripping sleeve 30 and terminates immediately behind the slot 36. The clamping disk 42 abuts against the abutment face 23 of the conical sleeve 19 at its one side, and against a control edge 44 formed on a pressure bell member 43 at its other side. The control edge 44 is produced by inclined cutting off of the end side of the pressure bell member 43 which is formed as a symmetrical body of revolution. A recoil spring 45 is arranged inside the bell member 43 and abuts with its one end against the latter and with its other end against the abutment bush 25. A further pressure spring 46 is inserted in the housing 1 at its rear end and abuts against a shoulder 47 and against a connecting piece 48 at the respective ends of the springs. The connecting piece 48 is displaceable over the conical sleeve 19 and has a supply opening 49 transitting in an inlet funnel 50. The connecting piece 48 is arranged in a supporting ring 51 which is screwed in the housing 1 with the aid of a thread. The above-mentioned supporting ring 51 can also serve for guiding a lead container 52 which accommodates a certain supply of further leads 51. The end of the lead container 52 is closed by a pressure knob 53. In dependence upon the length of the leads 41, several leads 41 are located between the front end of the lead protecting pipe 3 and the lead container 52 with abutment against driving faces 54.

In a writing instrument in accordance with a further embodiment of the present invention shown in FIGS. 6–9, the construction is based on the same principle on which the construction of the writing instrument in FIGS. 1–5 is based. Therefore, individual parts which are identical to those of the first embodiment are identified by identical reference numerals, whereas different parts are identified by new reference numerals.

Figure 9:
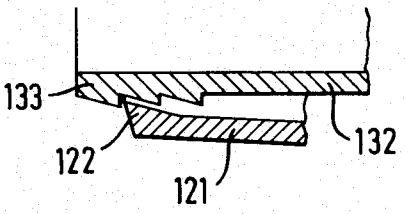
FIG. 9 is a fragmentary view showing coupling faces.
Figure 11:
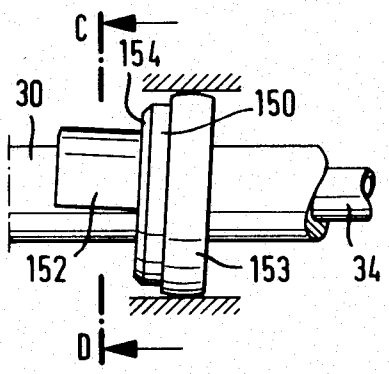
FIG. 11 is a view showing the coupling piece in a coupled position.
Figure 14:
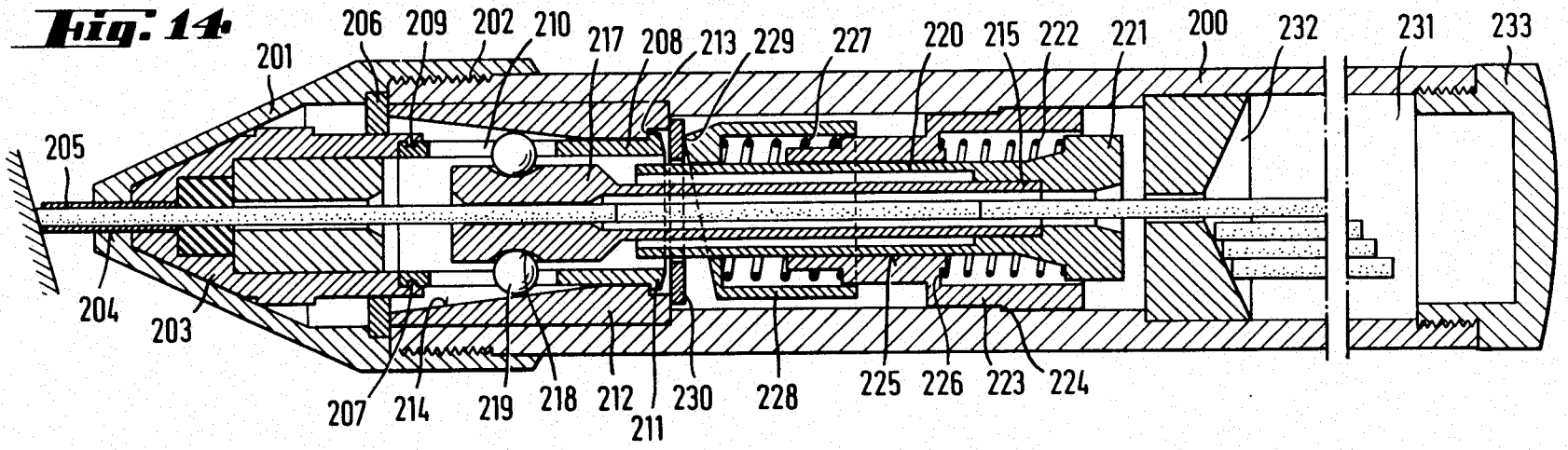
FIG. 14 is a view showing a longitudinal section of the writing instrument in accordance with still a further feature of the present invention in ready-to-write position.
Figure 15:
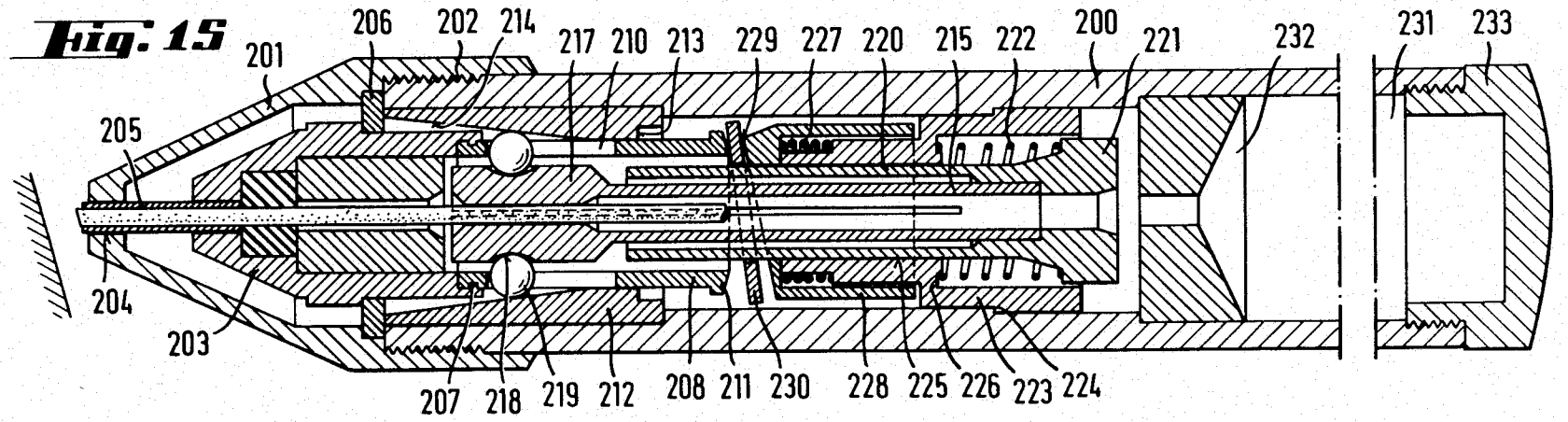
FIG. 15 is a view showing a longitudinal section of the writing instrument with withdrawn lead protecting pipe.
Figure 16:
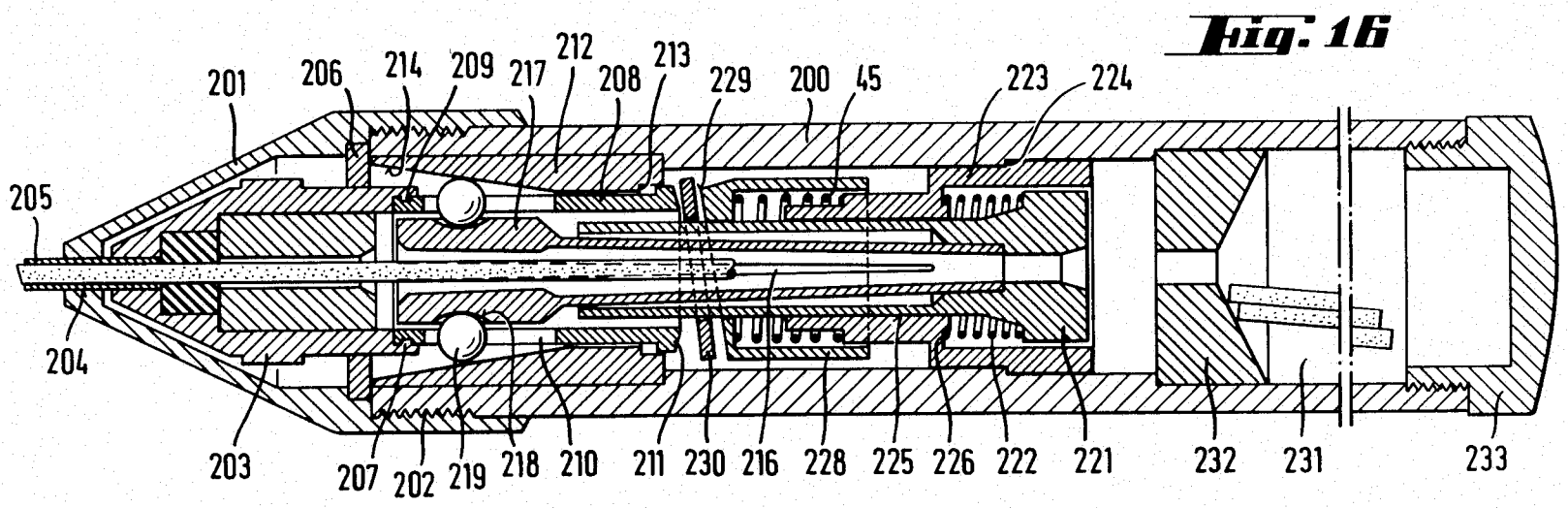
FIG. 16 is a view showing the writing instrument of FIG. 14 with an open clamping member.

A pressure sleeve 115 is also connected in this writing instrument with the displaceable member 7 and has an increased diameter so as to form an annular bead 116 which abuts in a conical sleeve 117 against an abutment 118. As can be seen from FIG. 7, the pressure sleeve 115 has an end facing toward the interior of the instrument and chamfered in a roof-like manner to form abutment edges 119. The abutment edges 119 form a pivot point or a pivot axis relative to a coupling bell member 120. The bell member 120 includes a sleeve portion 121 which is formed tooth-like at its end with the aid of a projection 122 as shown in FIG. 9. The sleeve portion 121 is connected with a supporting ring 123 with a spherical outer contour via an outer cone 124 forming a transition therebetween.

The bell member 120 is located in an opening 125 of the conical sleeve 117 so that the spherical supporting ring 123 allows turning of the bell member 120. In the inoperative position, the bell member 120 abuts with the outer cone 124 against the spherical surface 126 of the conical sleeve 117. This abutment is actuated by a recoil spring 127 which abuts in the bell member 120 on the one hand, and against the end side of an abutment bush 128, on the other hand. The abutment bush 128 is fixedly pressed in the conical sleeve 117 and its position is determined by an annular bead 129. The abutment bush 128 forms with its opening 130 an axial centering for the clamping member 34 which is mounted in a head piece 131 of a gripping sleeve 132. Keys 133 is provided on the front region of the outer surface of the gripping sleeve 132, the keys corresponding to the projections 122 on the bell member 120. The equalizing spring 40 is inserted between the abutment bush 128 and the head piece 131 of the gripping sleeve 132. As mentioned in the description of FIGS. 1–5, the equalizing spring 40 pulls the clamping members 34 into the inner cone 20 of the conical sleeve 117 and thereby brings the clamping arms 37 into abutment against one another or against the lead 41.

Figure 13:
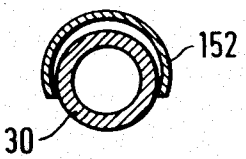
FIGS. 12 and 13 are views showing transverse sections through the coupling piece in uncoupled and coupled conditions.

FIGS. 10–13 show a further possibility of the design of the above-mentioned coupling bell member. A coupling bell member 150 is also formed as a rotation symmetrical body of revolution and has a sleeve portion 151 from which a section having a shape of the segment is separated, as can be seen from FIGS. 12 and 13. The remaining sleeve section 152 surrounds the gripping sleeve 30 over more than half of its periphery, whereby during tilting about a spherical supporting ring 153, abutment on the outer diameter of the gripping sleeve 30 surrounding the clamping member 34 is possible, as shown in FIG. 13. In the inoperative position, the bell member 150 with the aid of its outer cone 154 is centered in the conical sleeve 117 under the action of the recoil spring 127.

Figure 17:
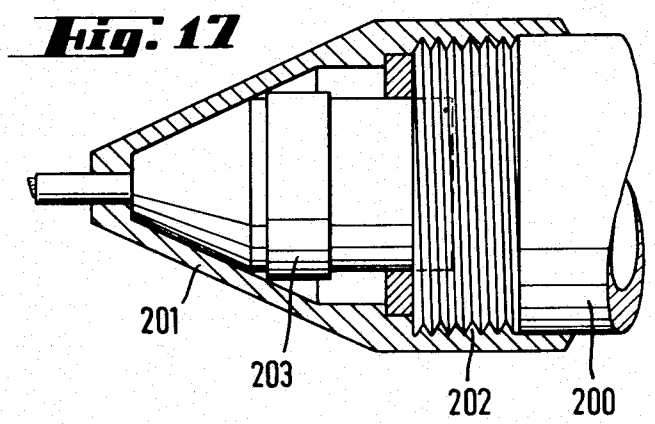
FIG. 17 is a view showing a partial section of the writing instrument of FIG. 14 with the advance writing tip.

The clamping member 34 and the gripping sleeve 30 in this embodiment of the coupling bell member 150 are identical to the respective parts of the embodiment of FIGS. 1–5. In the bell member 150 a transition between the sleeve portion 151 and the spherical supporting ring 153 is formed by an outer cone 154 which corresponds to the spherical face 126 of the conical sleeve 117. FIGS. 14–18 show a further embodiment of the writing instrument in accordance with the present invention, which has an especially simple construction and is characterized by non-complicated handling by a user which does not require any clarification. A housing 200 is connected with a tip 201 by a thread connection 202. The inclination of the thread connection 202 is selected so that a great axial movement of the part connected with one another takes place in response to a short rotary path. A displaceable member 203 is displaceably mounted in an outlet opening 204 of the tip 201 with the aid of a lead protecting pipe 205, and also in a supporting ring 206. The displaceable member 203 is interengageably connected with a pressure sleeve 208 by a snap bead 207 engaging in a groove 209 of the pressure sleeve 208. Similarly to the embodiment of FIG. 1, the pressure sleeve 208 has several cutouts 210 and transitsinwardly of the writing instrument into an annular bead 211 with a chamfered end side. A conical sleeve 212 is fixedly inserted in the housing 200. It abuts with its one end against an annular face 213 and with its another end with an inner cone 214 against the supporting ring 206 in the ready-to-write position of the instrument, as shown in FIG. 17.

A clamping member 215 has springy clamping arms 217 separated by a slot 216 and provided with spherical pockets 218 in which balls 219 are inserted. The balls 219 abut, on the other hand, against the inner cone 214 of the conical sleeve 212.

A gripping sleeve 220 is mounted on the clamping member 215 at its inner ends and partially surrounds the latter. The gripping sleeve 220 has a head piece 221 against which an equalizing spring 222 abuts with its one end. The other end of the equalizing spring 222 abuts against an abutment bush 223 which is inserted in fixed position in the housing 200 with the aid of a shoulder 224. The abutment bush 223 is provided with an opening 225 in which the gripping sleeve 22 is supported for longitudinal movement.

A further spring, namely a so-called recoil spring 227 abuts against an annular face 226 of the abutment bush 223 and has another end which abuts against a pressure bell member 228 supported on the gripping sleeve 220 and the abutment bush 223. The above-mentioned bell member 228 is formed as a symmetrical body of revolution which is chamfered at its end side to form a control edge 229. A clamping disk 230 is inserted between the pressure sleeve 208 and the bell member 228 and brought by the control edge 229 against the rear end side of the conical sleeve 212, as can be seen from FIG. 14. In this position of the clamping disk 230 which is retained in a play-free manner under the action of the recoil spring 227 between the conical sleeve 212 and the bell member 228, an insignificant play is available between the annular bead 211 and the clamping disk 230. In other words, the pressure sleeve 208 does not contact the clamping disk 230. This play is necessary to obtain an unobjectionable abutment of the clamping disk 230 and thereby a reliable uncoupling from the gripping sleeve 220.

A lead supply container 231 is provided in the housing 200 and has a bottom formed by a funnel-shaped insert 232. The lead supply container 234 is closed rearwardly by a cover 233.

The inventive writing instrument operates in the following manner:

In order to assume the ready-to-write position of the writing instrument shown in FIG. 1, the pressure knob 53 is removed and the lead container 53 is filled with one or several leads 41. When the writing instrument is held in a vertical position with downwardly directed tip 2, a lead 41 falls through the inlet funnel 50 into the supply opening 49 and through the lead guiding opening 32 of the clamping member 34 to the region of the clamping arms 37. The latter prevent further movement of the lead inasmuch as, under the action of the equalizing spring 40 upon the bottom of the slot 36, the clamping arms abut against one another and reduce the clamping opening 35 to a size which is smaller than the diameter of the lead 41. By displacement of the pressure knob 53, the connecting piece 48 is displaced against the action of the pressure spring 46 and takes along the conical sleeve 19 in a frictional manner in direction to the tip until the conical sleeve 19 abuts against the supporting ring 4. During this movement, the clamping member 34 does not change its position. During further pressing of the pressure knob 53, the connecting piece 48 acts upon the head piece 31 whereby during continuing displacement of the pressure knob 53, the clamping member 34 is displaced into the conical sleeve 19 and the clamping arms 37 open because of the increasing diameter in the inner cone 20. The balls 39 accommodated in the spherical pockets 38 reduce the friction between clamping member 34 and the conical sleeve 19. These balls 39 are, however, not absolutely necessary inasmuch as even in condition of higher friction between the clamping member 34 and the conical sleeve 19 the operation of the writing instrument is guaranteed.

The lead 41 falls further into the open clamping member 34 until it meets the elastic lead brake 11. When the pressure knob 53 is unloaded, the connecting piece 48, the lead container 52 and the pressure knob 53 return to their initial position under the action of the pressure spring 46. The connecting piece 48 returns the conical sleeve 19 in its initial position shown in FIG. 1 because of the friction of the connecting piece 48 relative to the conical sleeve 19.

The equalizing spring 40 is no longer blocked by the connecting piece 48 by abutment against the head piece 31. The clamping member 34 is also moved in the initial position under the action of the equalizing spring 40 and abuts in the region of the clamping opening 35 against the outer surface of the lead 41. When the pressure knob 53 is actuated for a second time, the above-mentioned movement is repeated and the lead 41 is pushed by a predetermined advancement stroke "v" forwardly through the elastic brake member 11. The advancement stroke "v" of the lead retained by the clamping member 34 is determined by the distance between the end side of the conical sleeve 19 to the supporting ring 4. In order to allow visible protrusion of the lead 41 out of the lead protecting pipe 3, the pressure knob 53 must be repeatedly actuated so frequently until the lead 41 is transported in stepped manner over the predetermined advancement stroke "v" through the braking member 11 to the end of the lead protecting pipe 3.

Upon actuating of the writing instrument in the above-described manner, the ready-to-write position is attained when the lead 41 is advanced so as to be flush with the front edge of the lead protecting pipe 3. When the writing instrument is placed onto an object to write on, lines can be drawn by utilization of the writing pressure. The lead 41 is being worn and the lead protecting pipe 3 is displaced inwardly in the tip 2 in correspondence with this wearing and simultaneously axially moves the displaceable member 7 and the pressure sleeve 15 in the same direction. The weight of the parts connected with the lead protecting pipe 3 and the friction force between the braking member 11 and the lead 41 are overcome, as well as the force of the recoil spring 45 and the sliding friction force of the mobile part. During this displacement of the lead protecting pipe 3, which follows the lead wear, the lead 41 is held in the clamping opening 35 of the clamping member 34. An automatic reinforcement or servo action takes place inasmuch as the friction between the mine 41 and the clamping openings 35 is greater than the friction of the clamping member 34 over the balls 39 in the conical sleeve 19.

This means that the clamping member 34 is pressed in the conical sleeve 19 and the holding force in the clamping member 34 is progressively increased. In the event of this possible movement of the clamping member 34 relative to the conical sleeve 19, only a minimum stroke takes place which can neither be traced by a user nor measured, since in dependence upon the applied writing pressure, this stroke can also be equal to zero.

During the movement of the lead protective pipe 3 with the displaceable member 7 in the tip 2 inwardly, the function of the clamping disk 42 is important. It can be understood from the consideration of FIGS. 4 and 5 in which the force conditions of the clamping disk 42 are schematically illustrated. As soon as the one sidedly chamfered annular bead 17 of the pressure sleeve 15 engages the clamping disk 42 at a location identified by arrow A, the clamping disk 42 turns from its initial position of FIG. 1 to its position shown in FIG. 4 inasmuch as the control edge 44 applies a counter force in direction of the arrow B whose point of application is spaced by a greater distance from the instrument center than the force applied from the pressure sleeve 15 in direction of the arrow A. During this turning movement of the clamping disk 42, a friction force generates at the location of contact of the opening of the clamping disk 42 with the outer diameter of the gripping sleeve 30 opposite to the control edge 44. This friction force at in direction of the arrow C, i.e. in the same direction in which the counter force [arrow B]applied from the control edge 44. Thereby it is prevented that the clamping disk 42 tilts on the gripping sleeve 30. Instead of the utilization of the gripping sleeve 30, it is also possible to form the clamping member 34 so that the clamping disk 42 comes to abutment in the unslotted region of its shaft.

In the illustrated position of the clamping disk 42 in FIG. 4, it can displace on the gripping sleeve 30 following the lead wear and the movement of the lead protecting pipe 3 into the interior of the instrument, until it assumes the position shown in FIG. 2 in which the bell member 43 abuts against the annular bead 29 of the abutment bush 25.

When the tip of the writing instrument is lifted from the object to write on, the recoil spring 45 can use its force and displace the bell member 43 in direction toward the tip 2, wherein a reverse of the force conditions takes place as schematically shown in FIG. 5. The force applied by the control edge 44 acts, as identified by the arrow B, in the same direction upon the clamping disk 42. Now it is greater than the counter force coming from the one-sidedly chamfered annular bead 17. Thereby tilting of the clamping disk 42 takes place with simultaneous direction reverse of the switching force acting between the clamping disk 42 and the gripping sleeve 30 in direction of the arrow C. The clamping disk 42 is thereby coupled with the gripping sleeve 30 and forms a fixed connection to the clamping member 34. The latter also moves under the action of the recoil spring 42 to the tip 2, inasmuch as the force of the recoil spring 45 is greater than the force of the equalizing spring 40. It can be seen from FIG. 3 how the recoil spring 45 axially moves the part connected with the displaceable member 7 and simultaneously brings the clamping member 34 to the open position. When the clamping disk 42 arrives at the annular face 22 of the conical sleeve 19, it is retained normal to the central axis of the housing 1 and releases simultaneously the coupling connection with the gripping sleeve 30 which subsequently moves back under the action of the equalizing spring 40 to the position shown in FIG. 1.

During the above-described movement of the clamping member 34 in direction toward the tip 2 to open the clamping member 34, a further lead 41 can be fed into the lead container 52 and then directy abuts on the surface 54 against the lead located in the lead protecting pipe 3. The surface 54 can extend at any suitable location from the front edge of the lead protecting pipe 3 to the rear region of the lead guiding opening 32 or the supply opening 49.

When the surface 54 lies in front of the end side of the clamping arms 37, both lead ends are pressed together because of the writing pressure, and a slight engagement or glueing takes place. This condition of both lead ends allows to completely wear out each lead without leaving a lead remaining portion in the writing instrument.

In the event of an error in actuating of the pressure knob 53 which is considered to be natural for the user, the lead 41 can project out of the lead protecting pipe 3 so long that the protective functions of the pipe 3 no longer takes place. It must be possible to bring back the projecting lead 41 to a position flush with the lead protecting pipe 3.

In the embodiment of FIG. 1 this is attained by a complete low pressure of the tension knob 53 whereby first the conical sleeve 19 moves frictionally to the tip 2 until it meets the supporting ring 4. During a further movement of the pressure knob 53, the connecting piece 48 slides on the conical sleeve 19 until it arrives at the rear edge of the head piece 31. And thereafter during further movement the clamping member 34 displaces forwardly so that the clamping arms 37 can open because of their own springy properties. With the open clamping member 34, slight pressure against the tip of the lead 41 moves the latter into the lead protecting pipe 3. When the pressure knob 53 is again released, it displaces under the action of the pressure spring 44 to the initial position and the writing instrument again assumes the ready-to-write position of FIG. 1.

Figure 6:
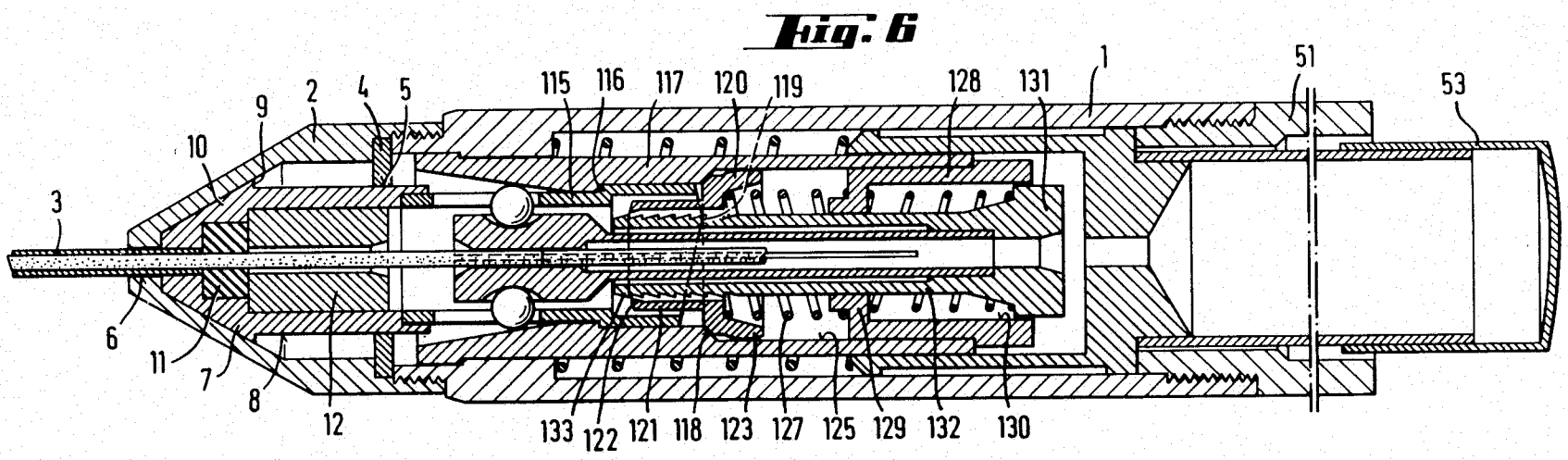
FIG. 6 is a view showing a longitudinal section of the writing instrument in accordance with a further embodiment of the present invention, provided with a coupling bell member.
Figure 8:
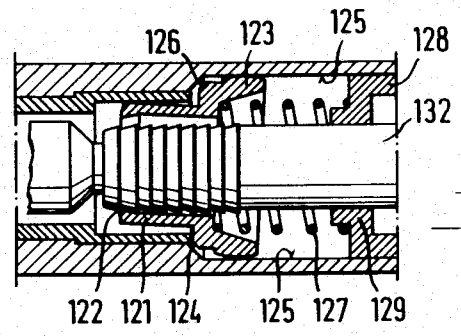
FIG. 8 is a partial view showing the coupling bell member during movement of the writing pipe out of the tip of the instrument.
Figure 7:
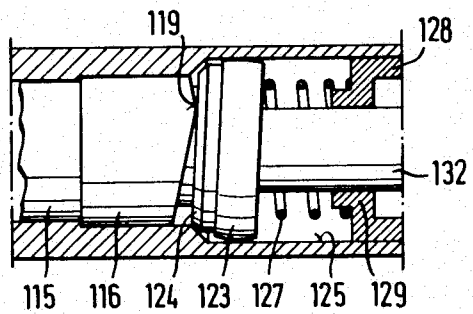
FIG. 7 is a partial view showing the coupling bell during movement of the writing pipe in a tip of the instrument.
Figure 10:
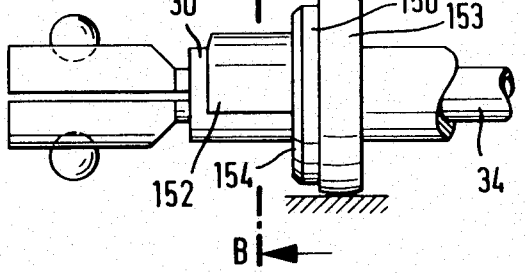
FIG. 10 is a partial view showing a further embodiment of the writing instrument with a coupling piece in an immovable position.

The writing instrument shown in FIGS. 6–9 operates in principle in the same manner as the writing instrument of FIGS. 1–5. The construction of these instruments is simpler because instead of the two coupling parts, namely the clamping disk 42 and the bell member 43, only one part, namely the coupling bell member 120 performs the same functions. For understanding the operation of this writing instrument, FIGS. 6 and 7 should be considered together. The writing instrument in accordance with FIG. 6 is in the ready-to-write position, wherein one lead 41 is flush with the front end of the lead protecting pipe 3. When the writing instrument is placed for writing on an object to write on and the writing pressure is applied, the lead 41 is held in the clamping member 34 in the same manner as mentioned in the description of FIG. 1. The inward movement of the lead protecting pipe 3 because of wearing of the lead displaces the pressure sleeve 115 inwardly and tilts the abutment edges 119 of the bell member 120, the abutment edges formed outwardly by two inclined faces. This tilting movement is possible because of the spherical shape of the support ring 123 which is supported in the opening 125 of the conical sleeve 117. As can be seen from FIG. 9, the projection 122 formed on the sleeve portion 121 engages in the keys 133 of the gripping sleeve 132. In dependence upon the length of the inward displacement of the pressure sleeve 115 by the lead protecting pipe 3, the projection 122 engages in one of the oppositely located keys 133. When the writing tip is unloaded, the action of the prestressed recoil spring 127 takes place and displaces the gripping sleeve 133 locked with the bell member 120 in longitudinal direction until the outer cone 124 arrives at the conical face 126 of the conical sleeve 117 and the bell member 120 is again placed straight, whereas the gripping sleeve 133 is unlocked. In this position of the bell member 120 the clamping member 34 connected with the gripping sleeve 132 again assumes its initial position under the action of the equalizing spring 40, and the writing instrument is in the ready-to-write position shown in FIG. 6.

The bell member 120 may be formed in a simple way as a rotary member and make possible a reliable connection to the gripping sleeve 132 which is connected with the clamping member 34. In this manner an especially reliable connection with the clamping member 34 is provided to retain the same open during the advancement providing the forward movement of the displaceable member 7. The pressure sleeve 115 may also be formed in a simple manner as an extruded member or as a rotary member with chamfered faces.

Figure 12:
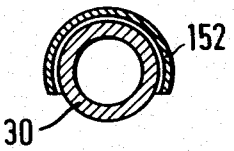

A possibility for formation of a bell member is shown in FIGS. 10–13. The bell member 150 has no projections for interengaging connection, but instead the sleeve portion 152 embraces the gripping sleeve 30 or more than a half of its periphery so that during the tilting movement for coupling purposes an edge contact on the outer periphery of the gripping sleeve 30 takes places as shown in FIG. 13. FIG. 12 shows a section of the gripping sleeve 30 wherein the bell member 150 is in its initial position and releases the clamping member 34 connected via the gripping sleeve 30.

The writing instrument shown in FIGS. 14–18 operates in principle in the same manner as the writing instrument shown in FIGS. 1–5 however with considerable difference in the fact that no pressure knob is provided for attaining the ready-to-write position. In order to assume this position, several leads 41 are supplied into the lead container 231, which can be done by lifting and placing back the cover 233. A first lead 41 falls in condition of vertical position of the instrument with the downwardly directed tip 201, into the funnel-shaped insert 233 and from there into the clamping member 215 until it reaches the clamping opening 35 of the clamping arms 217. In order to make possible a further passage of the lead 41, the lead protecting pipe 205 is thrust against an object to be write on whereupon the pressure sleeve 208 moves by the inwardy directed movement of the displaceable member 203 and turns the clamping disk 230 and the bell member 228 against the action of the recoil spring 227. After lifting of the lead protecting pipe 205 from the object, the operation described with respect to the writing instrument of FIGS. 1–5 is repeated, namely the coupling of the clamping member 215 with the bell member 228 takes place whereby opening of the clamping member 215 with the movement of the bell member 228 toward the tip. The clamping member 215 which opens during this movement makes possible a further passage of the lead 41 to the elastic braking member 11. When thereafter the same process, namely pressing of the instrument tip and following unloading, is repeated the elastic braking member 11 displaces on the lead 41 with overcoming its friction and the clamping member 215 retains the mine 41. By unloading the braking member 11 can pull the lead 41 out of the clamping opening 35. Similar repetitions of this process provide for a further advancement of the lead 41 until it becomes flush with the front edge of the lead protecting pipe 3. The further operation of this writing instrument is identical with the writing instrument shown in FIGS. 1–5.

The writing instrument without pressure knob actuation of FIGS. 14–18 is especially simple and non-complicated for the user, inasmuch as for setting the writing instrument into operation, the instrument must only be pressed several times against an object. This operation is usual for the user and known to him from working with writing instruments having fluid writing media. When pens or similar writing instruments are utilized, the user automatically presses the tip of the instrument against the object until a line is obtained. This can be performed in the same way for the writing instrument with solid lead, since here the repeated touching of the object actuates an automatic transportation of the writing medium.

Figure 18:
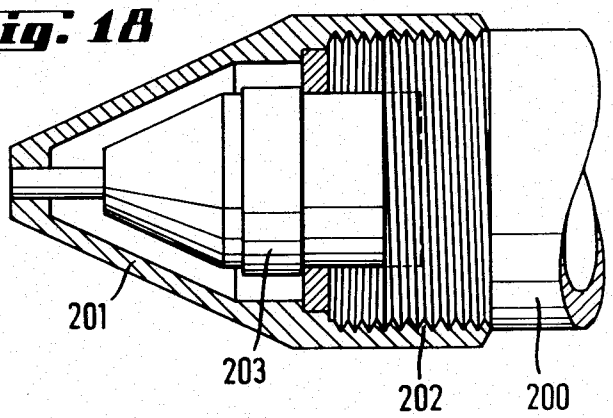
FIG. 18 is a view showing a partial section of the writing instrument with the withdrawn tip.

In FIGS. 17 and 18, the tip 201 is shown in its relative position to the housing 200. In FIGS. 17 the lead protecting pipe 205 projects outwardly beyond the tip 201. This position illustrates the ready-to-write position of the writing instrument which can also be seen in FIGS. 13–16. In order to insert the writing instrument without damaging the pockets of the cloths, the tip 201 is rotated relative to the housing 200 so that the lead protective pipe 205 is completely sunk. The thread connection 202 serves for this purpose and makes possible an axial displacement of the tip 201 toward the housing 200.

Figure 19:
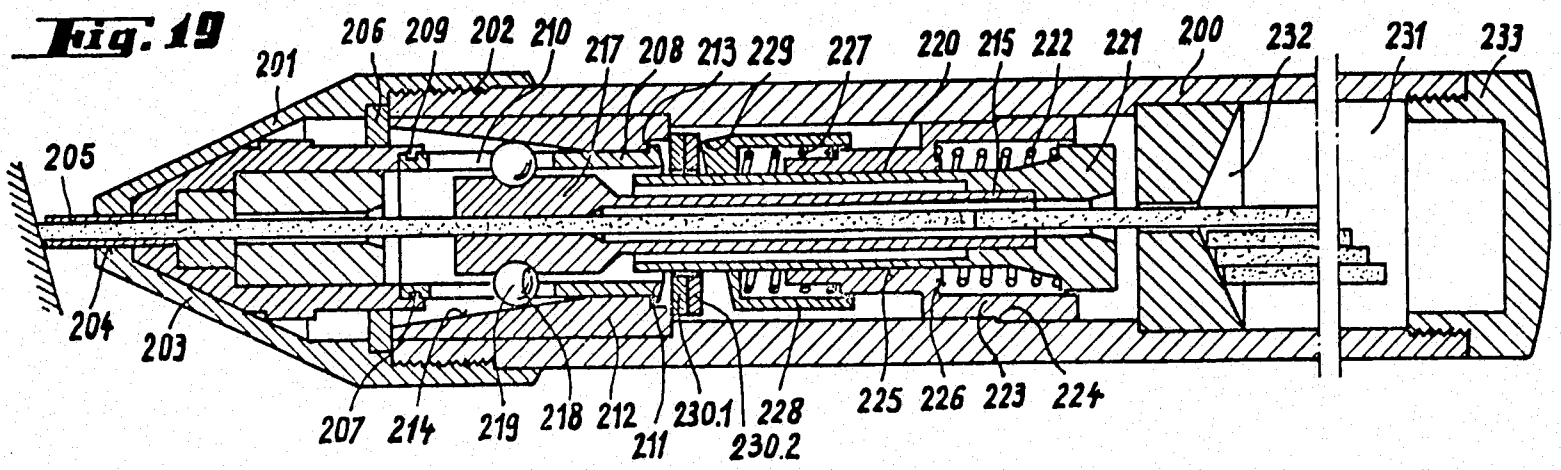
FIGS. 19 and 20 are views showing the writing instrument with a different clamping member in two positions.
Figure 20:
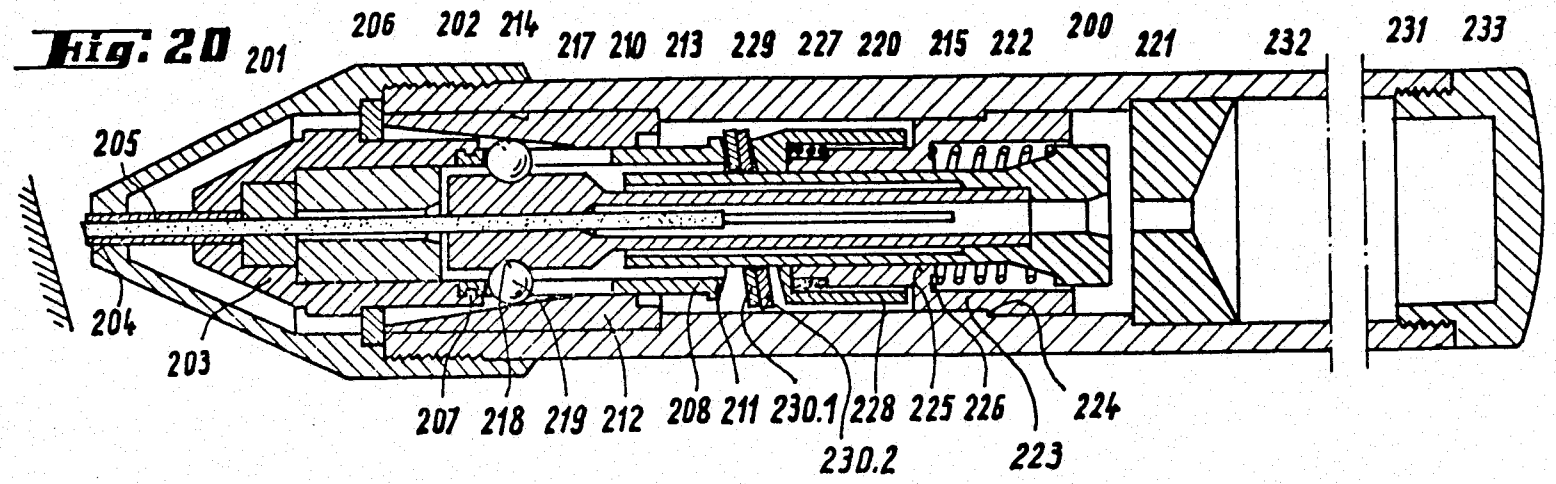

As can be seen from FIGS. 19 and 20, the clamping member may include a plurality, for example two, clamping discs, 230.1 and 230.2 shown in these Figures in two different positions.

It will be understood that each of the elements described above, or two or more together, may also find a useful application in other types of constructions differing from the types described above.

While the invention has been illustrated and described as embodied in a writing instrument with automatic advancement and feed of successive leads has a housing with a tip part, a lead protecting pipe having an axis and movable in an axial direction, a lead container spaced from the lead protecting pipe in the axial direction, a gripping sleeve extending between the lead container and the lead protecting pipe, a lead clamping member having a plurality of clamping arms and movable between open and closed positions in the axial direction with the clamping arms being arranged to abut against a gripping sleeve under a spring action and having a clamping opening with a receiving portion, wherein a tilting member is provided in a region of a shaft of the clamping member connected with the clamping arms and arranged so that during movement of the lead protecting pipe in the tip part of the housing the tilting member displaces on the shaft of the clamping member and during movement of the lead protecting pipe in an opposite direction out of the tip part the tilting member becomes firmly connected with the shaft of the clamping member.

It is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

What is claimed is:

1. A writing instrument with automatic advancement and feed of successive leads, comprising a housing having a tip part; a lead protecting pipe having an axis and movable in an axial direction; a lead container spaced from said protecting pipe in the axial direction; a gripping sleeve extending between said lead container and said lead protecting pipe; a lead clamping member having a plurality of clamping arms and movable between open and closed positions in axial direction, said clamping arms of said lead clamping member being arranged to abut against said gripping sleeve under a spring action and having a clamping opening with a receiving portion, said lead clamping member having a shaft connected with said clamping arms; a titling member surrounding said shaft of said clamping memeber and coupled with the latter, and following a wear of a lead located in said lead protecting pipe, said tilting member uncouples from said shaft at a plurality of locations of the latter and said shaft of said clamping member displaces in a stepless manner in correspondence with a path of movement of said lead protecting pipe and displaces said clamping member in the axial direction toward said tip part so as to open said clamping member so that a further lead moves freely from said lead container through said clamping member to abut against a rear end of the lead located in said lead protecting pipe, and during movement of said lead protecting pipe in an opposite direction out of said tip part of said housing said tilting member becomes again coupled with said shaft of said clamping member; a pressure sleeve connected with said lead protecting pipe, and having an annular collar, said tilting member having a control edge formed outside of a lead center and being pivotable about said control edge during the movement of said lead protecting pipe with said pressure sleeve; a recoil spring cooperating with said tilting member and forming an elastic abutment therefor; a conical sleeve having an abutment face and an inner cone in which said clamping member is axially movable; an equalizing spring arranged so that said clamping member moves in said conical sleeve against the action of said equalizing spring; and an axially movable bell member arranged under the action of said recoil spring and having a further control edge, said tilting member being formed as a clamping disc having a front side facing toward said tip part of said housing and abutting against said abutment face of said conical sleeve and said annular collar of said pressure sleeve, and a rear side abutting against said further control edge of said bell member.

2. A writing instrument as defined in claim 1, wherein said receiving portion of said clamping opening of said clamping arms of said clamping member is funnel shaped.

3. A writing instrument as defined in claim 1, wherein said shaft of said clamping member has a predetermined outer diameter, said clamping member having a slot extending over a predetermined region, said clamping disc being arranged on said shaft of said clamping member outside of the region of said slot and having an inner opening with an inner diameter exceeding the outer diameter of said shaft of said clamping member.

4. A writing instrument as defined in claim 3, wherein said clamping disc has a sharp-edged transistion between said opening of said clamping disc and said front and rear sides of said clamping disc.

5. A writing instrument as defined in claim 1, wherein said tilting member includes a plurality of such tilting disc abutting against each other.

6. A writing instrument as defined in claim 1, wherein said pressure sleeve has a further annular collar; and further comprising abutment bush movable relative to said bell member and having another annular collar, said conical sleeve having a bearing opening such that said pressure sleeve is axially movable in said opening of said conical sleeve between a front end position limited by abutting of said first-mentioned annular collar of said pressure sleeve against said abutment face of said conical sleeve, and a rear end position limited by the other annular collar of said abutment bush.

7. A writing instrument as defined in claim 1; and further comprising a displaceable member fixedly connected with said lead protecting pipe, said pressure sleeve being releasably connected with said displaceable member.

8. A writing instrument as defined in claim 1; and further comprising a displaceable member fixedly connected with said lead protecting pipe, said pressure sleeve having a plurality of recesses which form a plurality of further arms and a groove, said displaceable member having a snapping bead on which said further arms of said pressure sleeve engage via said groove.

9. A writing instrument as defined in claim 1, wherein said clamping member is axially movable in said conical sleeve, said pressure sleeve having a plurality of recesses each receiving a rolling body arranged between said inner cone of said conical sleeve and said clamping member.

10. A writing instrument as defined in claim 1; and further comprising a head piece mounted on said shaft of said clamping member, said gripping sleeve being formed on said head piece and at least partially surrounding said clamping arms of said clamping member.

11. A writing instrument as defined in claim 1; and further comprising an abutment bush, said shaft of said clamping member having a slotted region and an unslotted region the latter of which is axially movable in said abutment bush.

12. A writing instrument as defined in claim 11 wherein said abutment bush is fixedly mounted in said conical sleeve and further comprising a head piece provided on said shaft of said clamping member, and said equalizing spring arranged so that said clamping member with said shaft and said head piece is axially movable in said abutment bush under the action of said equalizing spring.

13. A writing instrument as defined in claim 12; wherein said abutment bush has an end portion, said head piece being arranged so that in said closed position it overlaps said end portion of said abutment bush.

14. A writing instrument as defined in claim 1, wherein said conical sleeve is arranged for receiving said clamping member and fixedly mounted in said housing.

15. A writing instrument as defined in claim 1, wherein said housing has a main part associated with said tip part and having an abutment; and further comprising an abutment ring arranged in said tip part, said conical sleeve being arranged for receiving said clamping member axially movable over a limited distance between said abutment ring of said tip part of said housing and said abutment of said main part of said housing.

16. A writing instrument as defined in claim 15; and further comprising a supporting ring, a connecting piece connected with said lead container and frictionally outwardly engaging said conical sleeve, a push button closing said lead container, and a pressure spring acting against said connecting piece.

17. A writing instrument as defined in claim 16; and further comprising a stop provided in said housing, and a supporting ring, said pressure spring being arranged so that its force is taken up by said stop of said housing and said supporting ring at the respective sides of said pressure spring.

18. A writing instrument as defined in claim 1, wherein said tilting member is arranged so that it is in a frictional connection with said clamping member during the movement of said lead protecting pipe out of said tip part of said housing.

* * * * *